US008201768B2

(12) United States Patent
Altesellmeier et al.

(10) Patent No.: US 8,201,768 B2
(45) Date of Patent: Jun. 19, 2012

(54) PIVOTABLE POSITIONING ROLLER IN THE REVERSING WINDER

(75) Inventors: Thomas Altesellmeier, Lienen (DE); Thomas Hawighorst, Hasbergen (DE); Rolf Kammann, Westerkappeln (DE); Carsten Plagge, Emsdetten (DE)

(73) Assignee: Windmoeller & Hoelscher KG, Lengerich (DE)

( * ) Notice: Subject to any disclaimer, the term of this patent is extended or adjusted under 35 U.S.C. 154(b) by 196 days.

(21) Appl. No.: 12/311,699

(22) PCT Filed: Oct. 9, 2007

(86) PCT No.: PCT/EP2007/060692

§ 371 (c)(1),
(2), (4) Date: Apr. 9, 2009

(87) PCT Pub. No.: WO2008/043748

PCT Pub. Date: Apr. 17, 2008

(65) Prior Publication Data

US 2009/0321551 A1 Dec. 31, 2009

(30) Foreign Application Priority Data

Oct. 9, 2006 (DE) ..... 10 2006 047 995

(51) Int. Cl.
*B65H 19/22* (2006.01)

(52) U.S. Cl. ..... 242/533.4; 242/533.5

(58) Field of Classification Search ..... 242/533.2, 242/533.4–533.5, 547

See application file for complete search history.

(56) References Cited

U.S. PATENT DOCUMENTS

| | | | | |
|---|---|---|---|---|
| 4,422,586 | A * | 12/1983 | Tetro | 242/527.3 |
| 4,431,140 | A | 2/1984 | Tetro | |
| 4,529,141 | A * | 7/1985 | McClenathan | 242/527.1 |
| 4,798,350 | A * | 1/1989 | Jorgensen et al. | 242/521 |
| 4,971,263 | A | 11/1990 | Belongia et al. | |
| 5,035,373 | A * | 7/1991 | Perrigo | 242/413.3 |
| 5,054,707 | A | 10/1991 | Olson | |
| 5,221,056 | A | 6/1993 | Walliser et al. | |
| 5,520,352 | A * | 5/1996 | Prix et al. | 242/527.3 |

FOREIGN PATENT DOCUMENTS

| | | | |
|---|---|---|---|
| DE | 2 203 696 | A1 | 8/1973 |
| EP | 0 521 396 | A1 | 1/1993 |
| JP | 59 057847 | A | 4/1984 |
| JP | 2 095649 | A | 4/1990 |

* cited by examiner

*Primary Examiner* — Sang Kim
(74) *Attorney, Agent, or Firm* — Jacobson Holman PLLC

(57) ABSTRACT

A winding device for winding up a web-like material has a roll core, on which the web-like material is wound up into a material roll, and a web guiding roller, which guides the web-like material before or when the web-like material reaches the roll core or the material roll, and a pressing element, which presses the web-like material onto the roll core or the roll after the web-like material already rests on the roll core or the roll. The pressing element is movable in relation to the roll core, and is mounted at both ends in lever arms forming a lever arm pair. The lever arms are mounted so as to be rotatable, and so that the pressing element is pivotable around bearing points of the lever arms.

11 Claims, 9 Drawing Sheets

PIVOTABLE POSITIONING ROLLER IN THE REVERSING WINDER

CROSS-REFERENCE TO RELATED APPLICATION

This is a national stage of PCT/EP07/060,692 filed Oct. 9, 2007 and published in German, which has a priority of German no. 10 2006 047 995.5 filed Oct. 9, 2006, hereby incorporated by reference.

BACKGROUND OF THE INVENTION

1. Field of Invention

The invention relates to a winding device for winding up a web-like material as described herein.

2. Description of the Prior Art

Web-like material, such as plastic film, which is produced in a web production device, such as an extrusion device, is frequently not processed further directly, i.e., "in-line", but rather first wound up into rolls using a so-called winding device. These rolls are first supplied to a further processing machine. Such further processing machines include printing presses, bag production machines, and many other machines.

Other materials, such as paper, are also wound up in a winding device and supplied to a further processing machine in the form of rolls.

These rolls are frequently formed in that the web-like material is wound onto a roll core. Before the web-like material reaches this roll core and/or the roll, on which web-like material is already wound, it is guided over a web guiding roller. This web guiding roller may be situated at a small distance to the roll core or to the roll (so-called "gap winder") or may press the web-like material directly onto the roll core or the roll. In the latter case, the winding device is referred to as a contact winder. In both cases, the cited web guiding roller is typically the last roller over which the web-like material is guided before or when it reaches the roll core or the roll.

To prevent an air inclusion between the roll core or the roll and the new layer of the web-like material, a pressing element is frequently assigned to the roll, which may be positioned against the roll. This pressing element is typically designed as a pressing roller.

In known winding devices, the mechanism which is used for positioning the pressing elements on the roll, comprises carriages, in which the pressing roller or the pressing element is mounted on both ends, the carriages being situated so they are displaceable on two rails running parallel to one another. These rails are fastened to walls which also support the roll core. The carriages on which the pressing rollers are mounted are moved in the direction toward or away from the roll core using suitable actuators, such as a piston-cylinder unit.

This way of positioning the pressing roller on the roll core has the disadvantage of the large space requirement caused by a linear guide of the carriages.

The object of the present invention is to propose a winding device, in which the mechanism which is used for positioning the pressing element on the roll requires less space.

The object is achieved by a winding device as described herein.

SUMMARY OF THE INVENTION

Accordingly, the pressing element is mounted on both ends in lever arms, which form a lever arm pair. This pressing element may be a pressing roller, which is mounted so it is rotatable in this lever arm pair. The lever arms are mounted so they are rotatable in the walls, in which the roll core is also mounted. Because the bearing points of the pressing element in the lever arms and the bearing points of the lever arms in the walls are not coincident, the pressing element is finally pivotable around the bearing points of the lever arms.

In this way, rails are no longer necessary for the movement of the pressing element, but rather only lever arms, which are mounted so they are rotatable in one point. For this reason, the winding device according to the invention may be constructed significantly more compactly than a winding device according to the known prior art.

The question of the space requirement in so-called turret winders is of decisive significance. In this type of winding device, the roll core and the mechanism for positioning the pressing element are fastened on discs or plates, which are mounted so they are rotatable in the machine framework. At least one second roll core and at least one further mechanism for positioning pressing elements are mounted and/or fixed on each of these discs or plates. A turret winder is used, after a roll has been completely wound, for the rapid winding onto the second roll core of the new web beginning formed by a cut. An especially advantageous embodiment of a winding device according to the invention therefore comprises the cited features of a turret winder. Particularly in this case, the space requirement of the mechanism for positioning the pressing element directly influences the size of the discs and/or plates and also the drive power which is necessary for their rotation in the machine framework.

In an advantageous refinement of the invention, the pivot range of the lever arms is dimensioned in such a way that a pressing roller may come into contact with two roll cores alternately. In this way, the pressing roller, which does not have its own rotational drive, may be set into rotation by a rotating roll core. The pressing roller may thus be accelerated before it contacts the roll. An acceleration of the pressing roller by the roll on which web-like material has already been wound may result in damage to the web-like material.

Drive means are advantageously assigned to the roll cores, which apply a torque to the roll cores. A separate drive may be assigned to each roll core. Alternatively, two or more roll cores may be driven by one drive, a detachable coupling being provided between the drivetrain and the roll core to be able to stop the roll for the purpose of removal, while a further roll core is wound further.

In addition, the object of the invention is a method for the continuous winding of a web-like material into rolls as described herein. Further method steps which are part of the method according to the invention are described hereafter in the context of the description of the object.

Further exemplary embodiments of the invention are disclosed in the description of the object and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
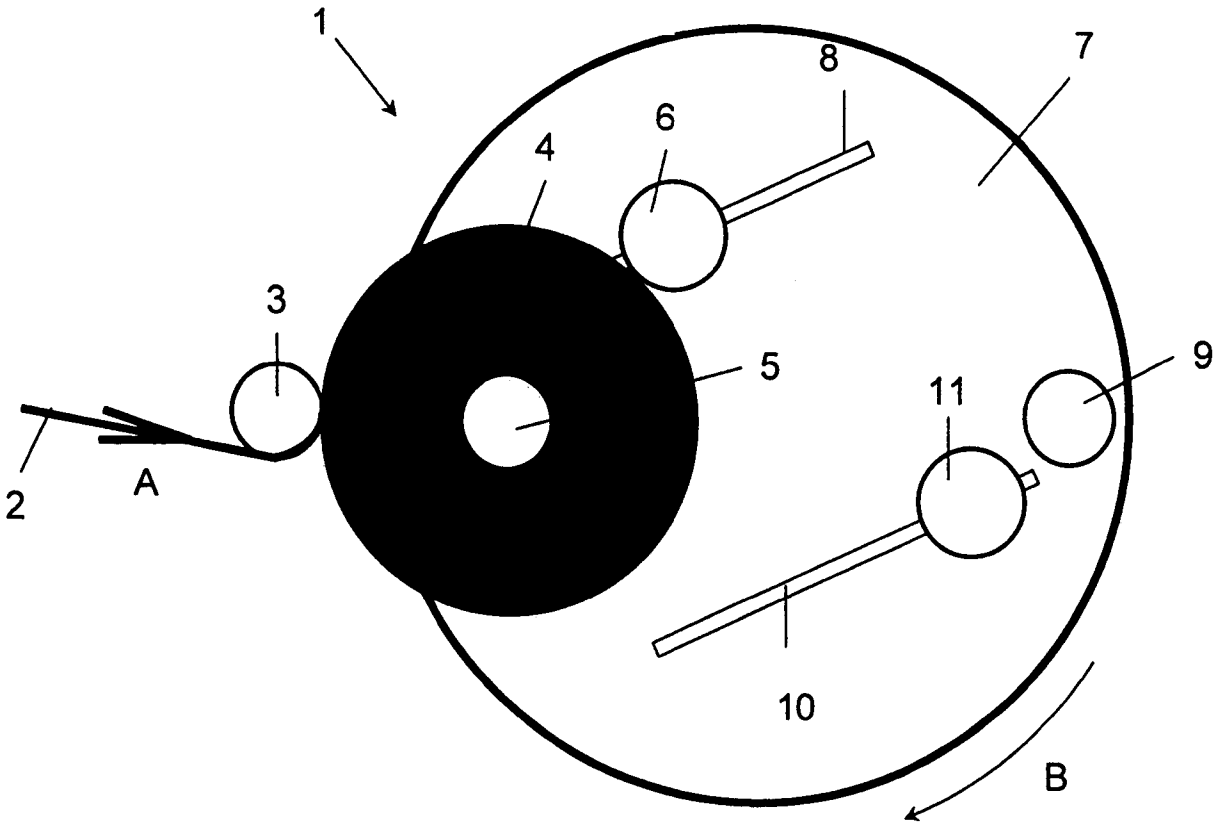
Fig. 1 Prior art
FIG. 1 shows a schematic side view of a winding device according to the prior art.

FIG. 1 shows a winding device according to the prior art. In this case, the web-like material 2, which is supplied to the winding device in the run direction A, is guided via the contact roller 3. The contact roller 3 is positioned on the roll 4, which is wound on a roll core 5, so that the web-like material guided by the contact roller 3 is laid on the roll. A pressing roller is positioned on the roll 4 in the transport direction of the material behind the contact roller, which presses the uppermost layer of the web-like material 2 with pressure against the roll 4, in order to prevent air inclusions. The so-called roll hardness may be established by the strength of the pressing.

The roll core 5 is mounted so it is rotatable on both ends in discs, of which only the rear disc 7 is shown. The discs are in turn mounted so they are rotatable in the machine framework (not shown). The contact roller 3 is also mounted on the machine framework via elements which allow a movement of the contact roller 3 in relation to the roll core 5.

The pressing roller 6 is mounted via displacement carriages (not shown) in guides 8, the guides being fastened on the rails. The pressing roller 6 may be displaced in relation to the guides and thus in relation to the roll core 5 with the aid of piston-cylinder units or other suitable drives.

A second roll core 9 and further guides 10 are also mounted and/or fastened in the cited discs. The guides 10 also support a second pressing roller 11, which is assigned to the roll core 9, via these displaceable carriages.

By rotating the discs 7, the roll core 9 may be pivoted in the direction toward the contact roller, so that this roll core 9 comes into contact with the web-like material. The roll 4 is pivoted away from the contact roller 3 by the rotation of the discs. The web-like material may now be cut through by a cutting device (not shown), so that a new web beginning results, which may be fixed on the roll core 9 by suitable means. The old roll 4 may now be removed from the winding device and replaced by an empty roll core. In this way, a new roll results without the winding device having to be stopped for the purpose of changing the roll core.

Figure 2:
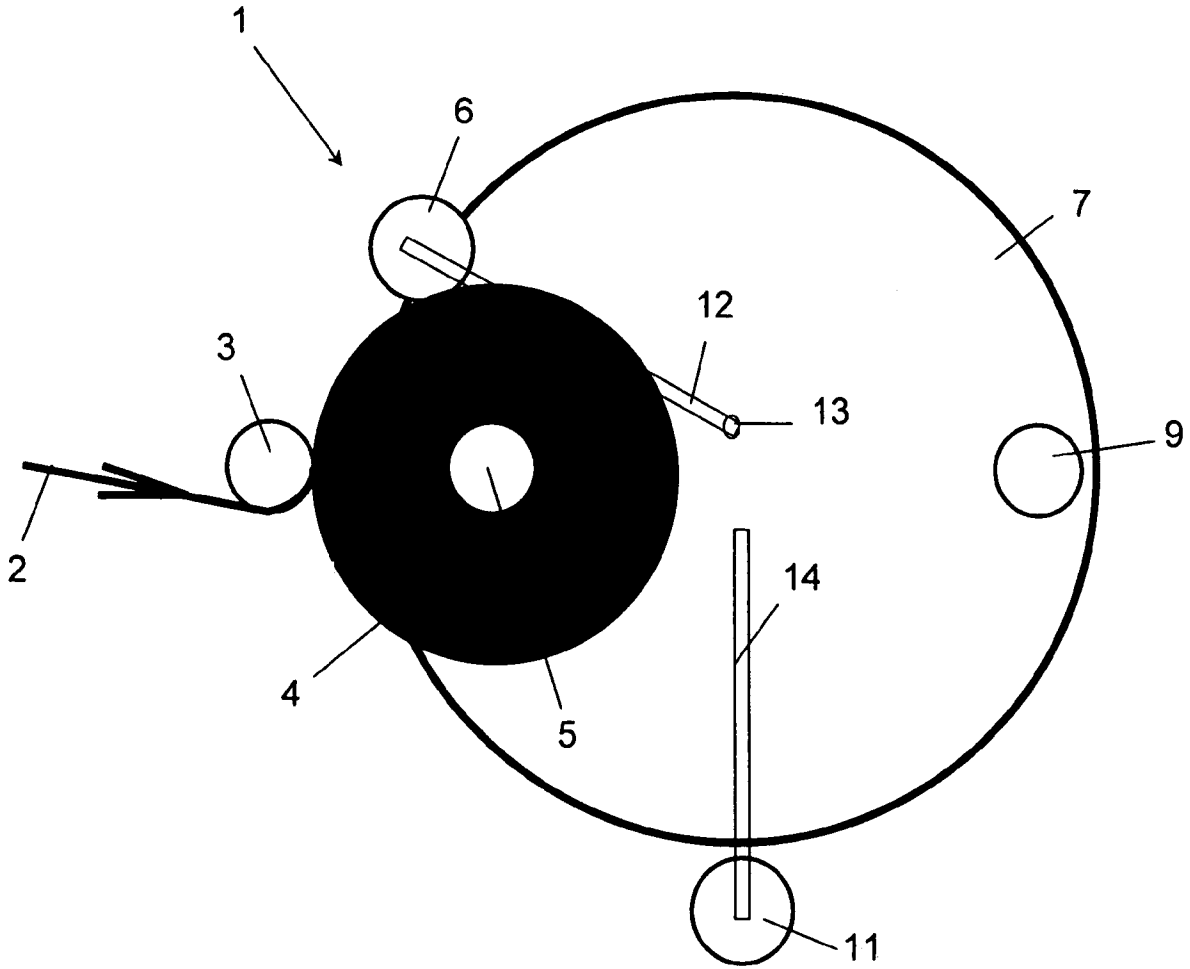
FIG. 2 shows a schematic side view of a winding device according to the invention during the winding operation.

FIG. 2 shows a winding device 1 according to the invention during the winding operation. The identical elements to the winding device shown in FIG. 1 are provided with the same reference numerals in FIG. 2. In contrast to the winding device according to the prior art, in the device according to the invention, the pressing roller 6 is mounted in a lever arm pair, of which only the rear lever arm 12 is shown. Both lever arms of the lever arm pair are connected to one another via suitable coupling elements, such as connecting rods, so that the rotational axis of the pressing roller always runs parallel to the rotational axis of the roll core.

In an advantageous embodiment, a gear ring or gear ring segment is fastened for this purpose on each disc 7, on which gear wheels fastened to a coupling shaft roll. Further gear wheels may be provided between gear ring or gear ring segment and gear wheels of the coupling shaft. The coupling shaft may be guided through an axial hole of the pressing roller 6, 11. If a torque is applied to one of the two lever arms, the coupling shaft rotates and transmits a torque to the particular other lever arm, the end of the coupling shaft which is mounted so it is rotatable in the other lever arm also rolling on a gear ring or gear ring segment. In this way, an exactly equal angle of the lever arms is ensured. This state of affairs is explained hereafter on the basis of FIG. 9.

The lever arm 12 is mounted via a bearing 13 in the disc 7. The rotational axis of the pressing roller 6 is parallel to the rotational axis of the bearing 13. However, both axes are not aligned. This is also true for all other lever arms which are shown in these and the following figures, but also for the lever arms which are not shown.

The pivoting of the lever arm is performed, for example, by a drive motor onto whose rotor axis a pinion is plugged and fastened. This pinion engages with a gear wheel or gear wheel segment, which is fastened on a lever arm and whose rotational axis is aligned with the rotational axis of the bearing 13. An air motor, which is very compact and light, is preferred as the drive motor. This is discussed in still greater detail hereafter in the context of the description of FIG. 9.

The pressing roller 11, which is mounted and driven in the lever arm 14 similarly to the pressing roller 6 mounted in the lever arm 12, is shown in a position pivoted away from the roll core 9 in the operating situation shown in FIG. 2.

Figure 3:
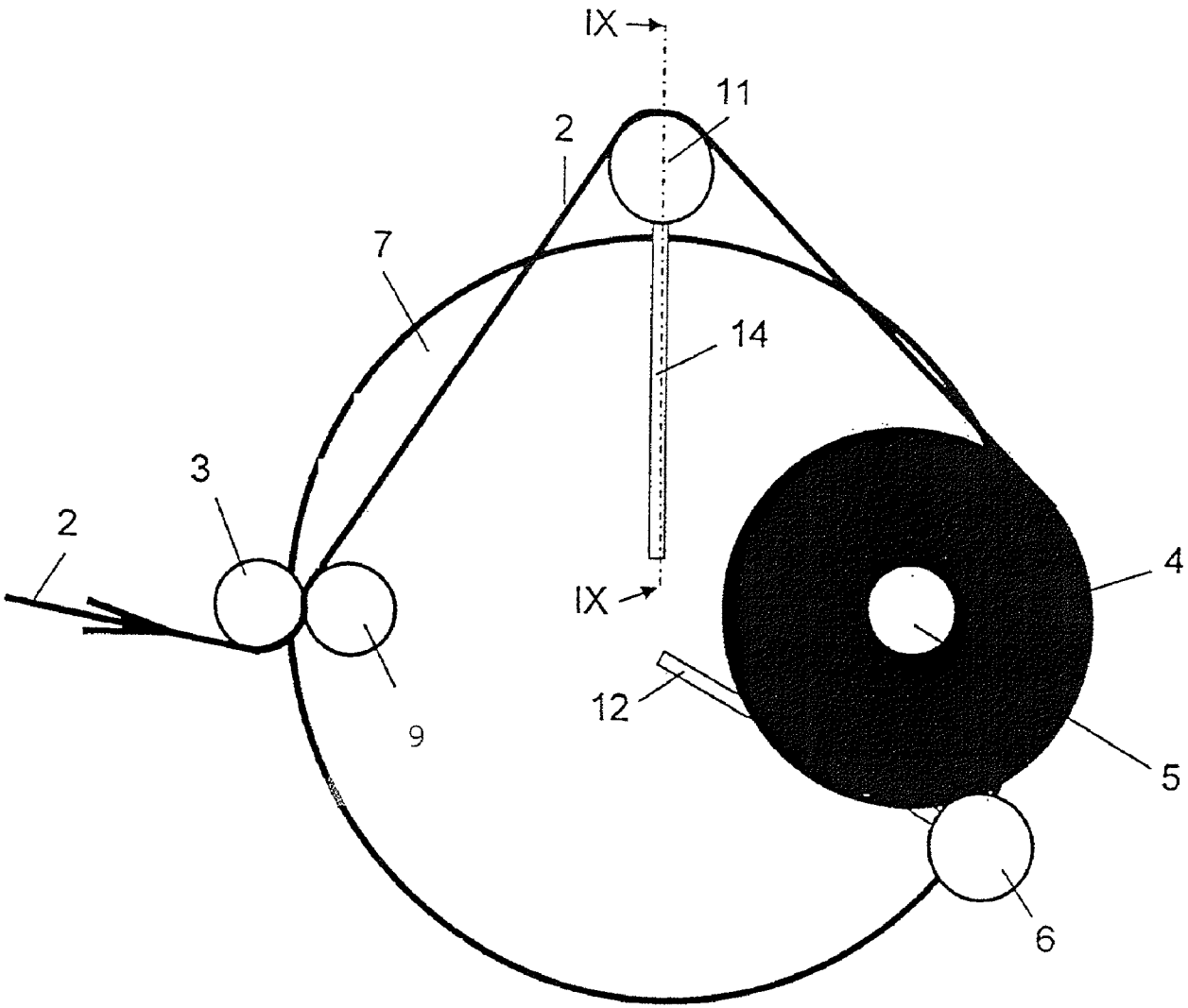
FIG. 3 shows a schematic side view of a winding device according to the invention during the roll core change.

FIG. 3 shows the winding device 1 according to the invention already shown in FIG. 2, after the discs have been rotated far enough that the roll core 9 assumes the original position of the roll core 5. The web-like material 2 is first wound further onto the roll in the situation shown, the web-like material 2 also running over the pressing roller 11.

After the operating situation shown has been achieved, the web-like material is cut through by a cutting device (not shown). The web end thus resulting is wound further onto the roll 4. The web beginning resulting due to the cutting of the web-like material is fixed on the roll core 9 by a suitable measure, such as fixing by an adhesive. The web-like material 2 is now wound onto the roll core 9. In the meantime, the resulting web end has reached the old roll 4, so that the pressing roller 11 is no longer in contact with the web-like material 2. As soon as the new web beginning has been fixed on the roll core, the lever arm 14 is pivoted in the direction toward this roll core and the pressing roller 11 is thus positioned on the roll core. After the replacement of the roll 4 by a new roll core, the changing procedure is completed and the operating situation shown in FIG. 2 is reproduced.

It is to be emphasized that the winding device shown in FIGS. 2 and 3 is used in particular with slowly running web-like material. The reason for this may be seen in that the pressing roller 11, which is at rest or even rotates opposite to the web direction from the prior winding on the roll core 9 in the position shown in FIG. 2, must be set into rotation and/or into opposing rotation by the web-like material as soon as they come into contact. A high transport velocity of the material 2 would also make a high acceleration of the pressing roller necessary, however, and would thus require a large force. The forces acting in this case may result in damage of the web-like material, however. The limit at which the described device may still be used without damaging the web-like material is a transport velocity of 150-200 m/minute, this limit also being able to be a function of the material properties.

A winding device which is also suitable for winding up rapidly running material is shown in FIGS. 4 through 8.

Figure 4:
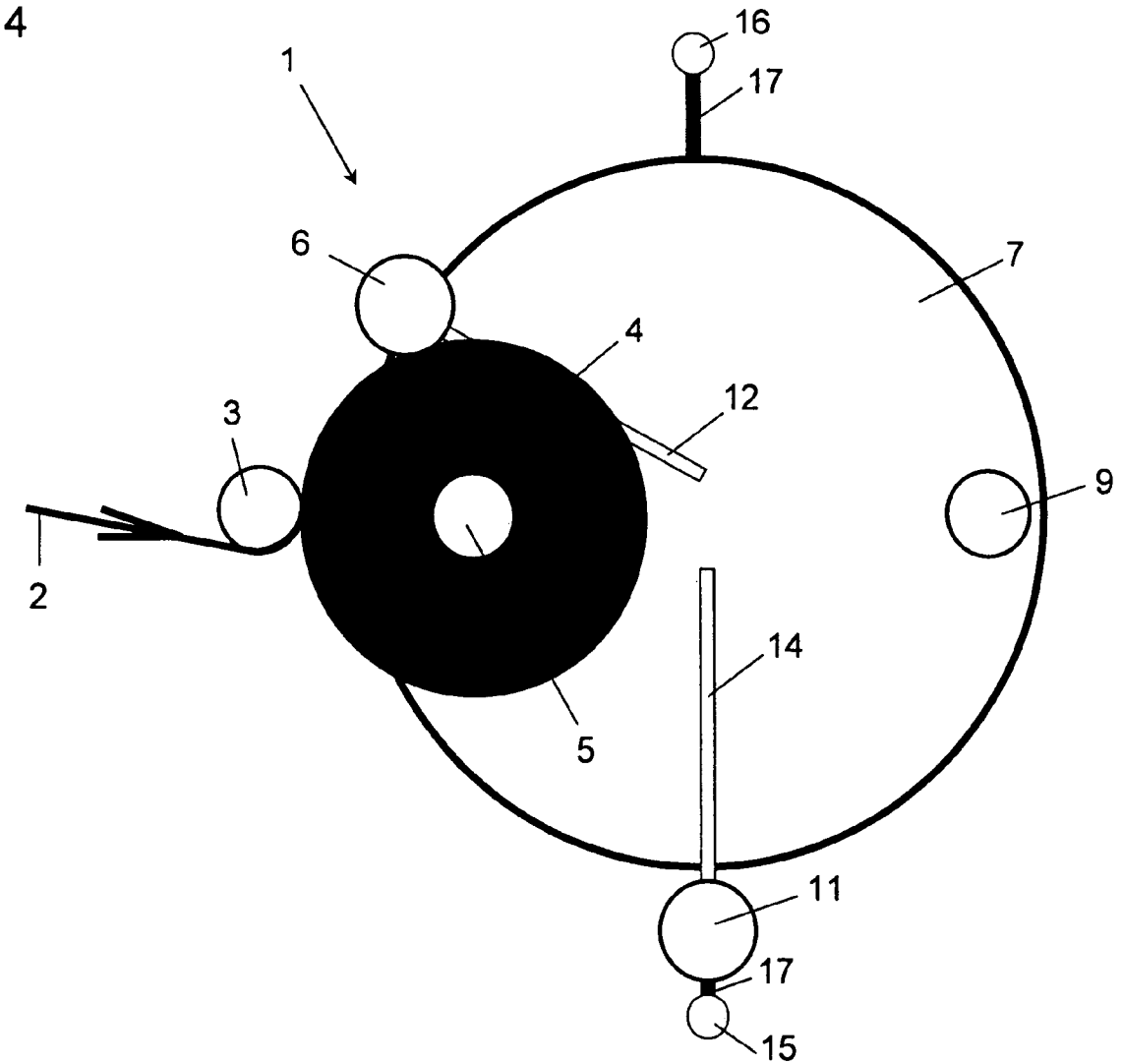
FIG. 4 shows a schematic side view of a winding device according to the invention having deflection pulleys during the winding operation.

FIG. 4 schematically shows a further embodiment of the winding device 1 according to the invention. This winding device essentially corresponds to the winding device shown in FIG. 2, but the device shown in FIG. 4 additionally comprises deflection pulleys 15 and 16. These deflection pulleys 15 and 16 are mounted so they are rotatable in holders which are fastened on the discs. The number of the deflection pulleys is not restricted to two, multiple deflection pulleys may be provided. Only the holders 17 fastened on the rear disc are shown in FIG. 4. The function of the deflection pulleys 15, 16 will become clear on the basis of the following description of FIGS. 5 through 8, in which the roll core changing procedure is illustrated.

Figure 5:
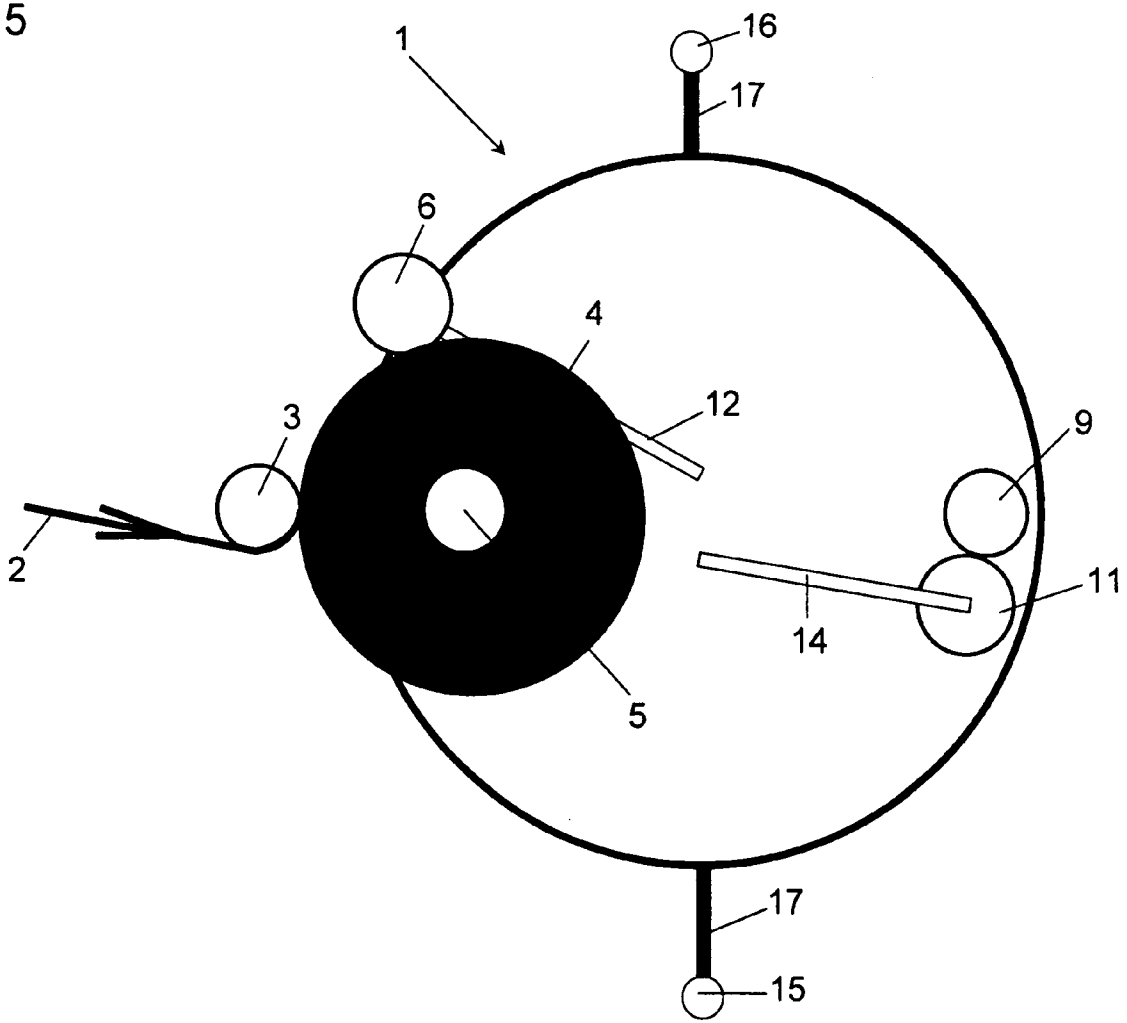
FIG. 5 shows a schematic side view of a winding device according to the invention having deflection pulleys during the preparation for the roll core change.

FIG. 5 shows the winding device 1, in which the lever arm 14 has been pivoted in the direction toward the roll core 9, so that the pressing roller 11 is frictionally engaged with the roll core 9. The roll core 9 is set into rotation by a drive, by which the pressing roller 11 is also set into rotation. The rotational velocity is selected so that the peripheral velocity of the pressing roller 11 essentially corresponds to the transport velocity of the web-like material.

Figure 6:
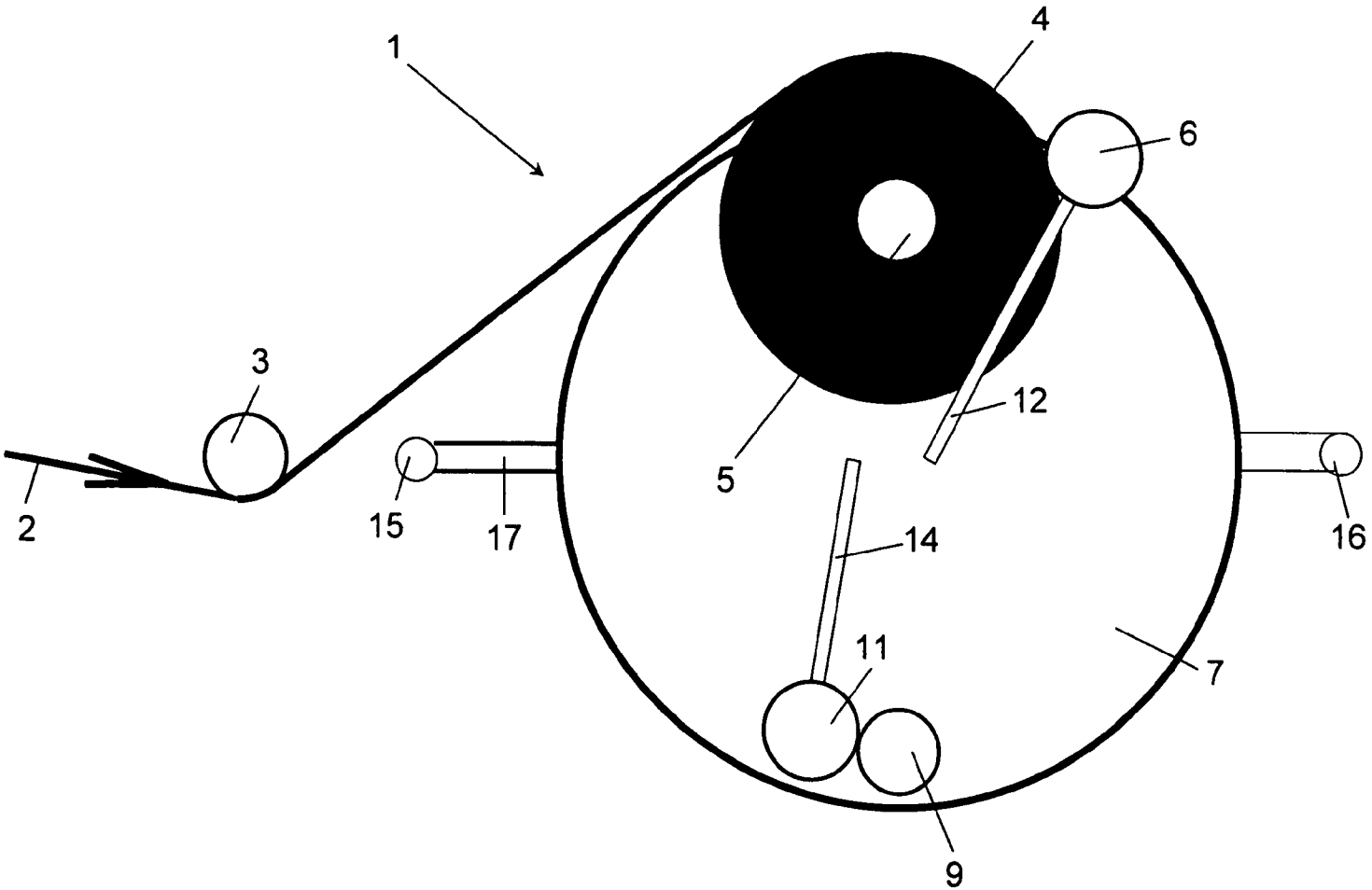
FIG. 6 shows a schematic side view of a winding device according to the invention having deflection pulleys during the roll core change.
Figure 7:
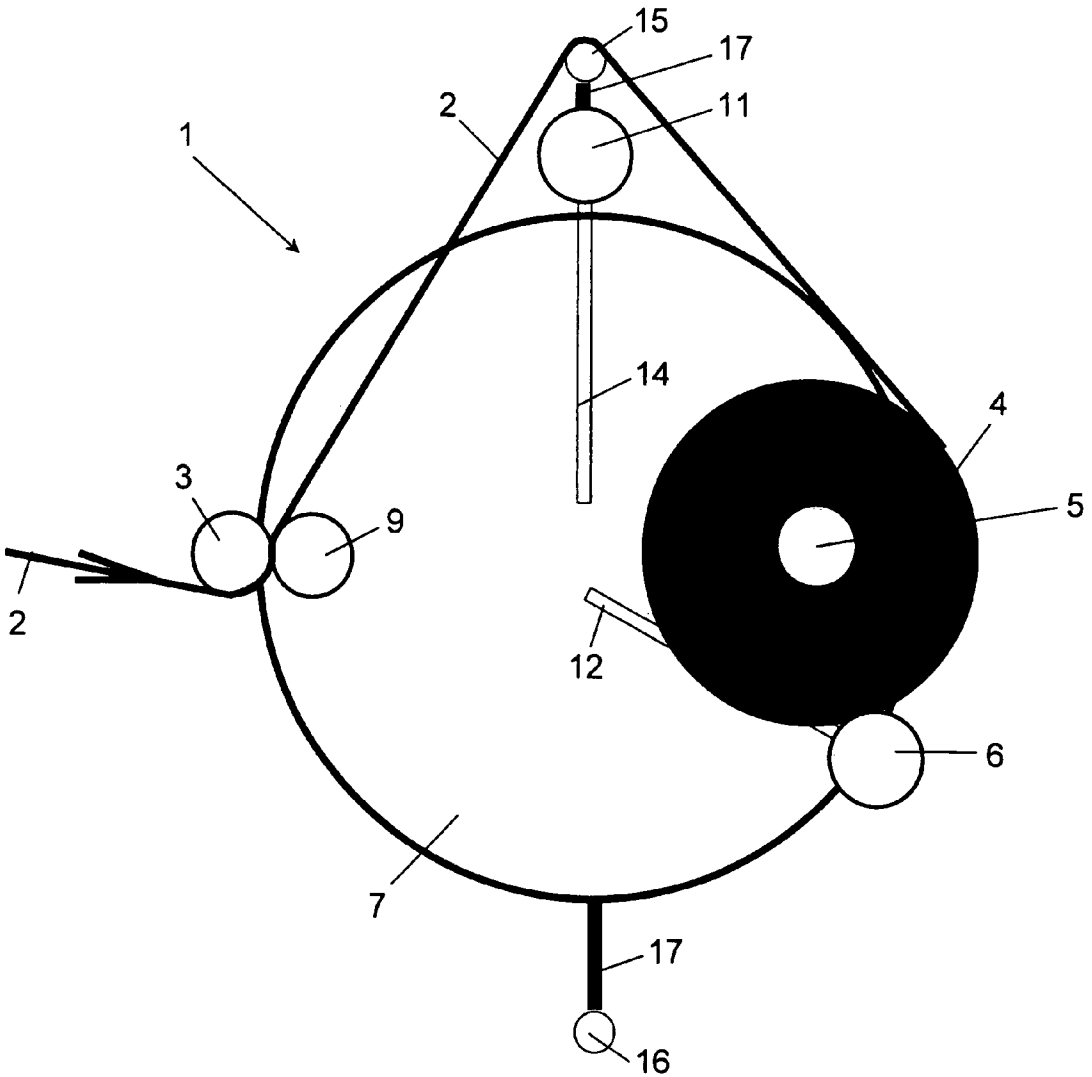
FIG. 7 shows a schematic side view of a winding device according to the invention having deflection pulleys during the roll core change.

In FIG. 6, in comparison to FIG. 5, the contact roller 3 is first displaced in relation to the disc 7 so that it is no longer in contact with the roll 4. The discs are subsequently rotated by an angle of approximately 90°. At this rotational angle, the deflection pulley 15 nearly comes into contact with the web-like material 2. The deflection pulley 15 may have an external pre-accelerator as a function of the material. However, it may also be set into rotation by the web-like material. The deflection pulley has a small diameter and is manufactured from a light material, so that only a small torque must be applied for its acceleration in comparison to the acceleration of a pressing roller. The deflection pulleys may therefore be used in spite of high transport velocities of the web-like material. During the further rotation of the discs, the lever arm 14 is pivoted until it runs approximately parallel to the holder 17. The pivoting is performed chronologically so that the pressing roller 11 does not touch the web-like material 2 as much as possible. The rotary impulse of the non-driven pressing roller 11 is maintained or decreases only slightly. The rotation of the disc occurs further until the new roll core 9 has come into contact with the web-like material 2. This situation is shown in FIG. 7.

Figure 8:
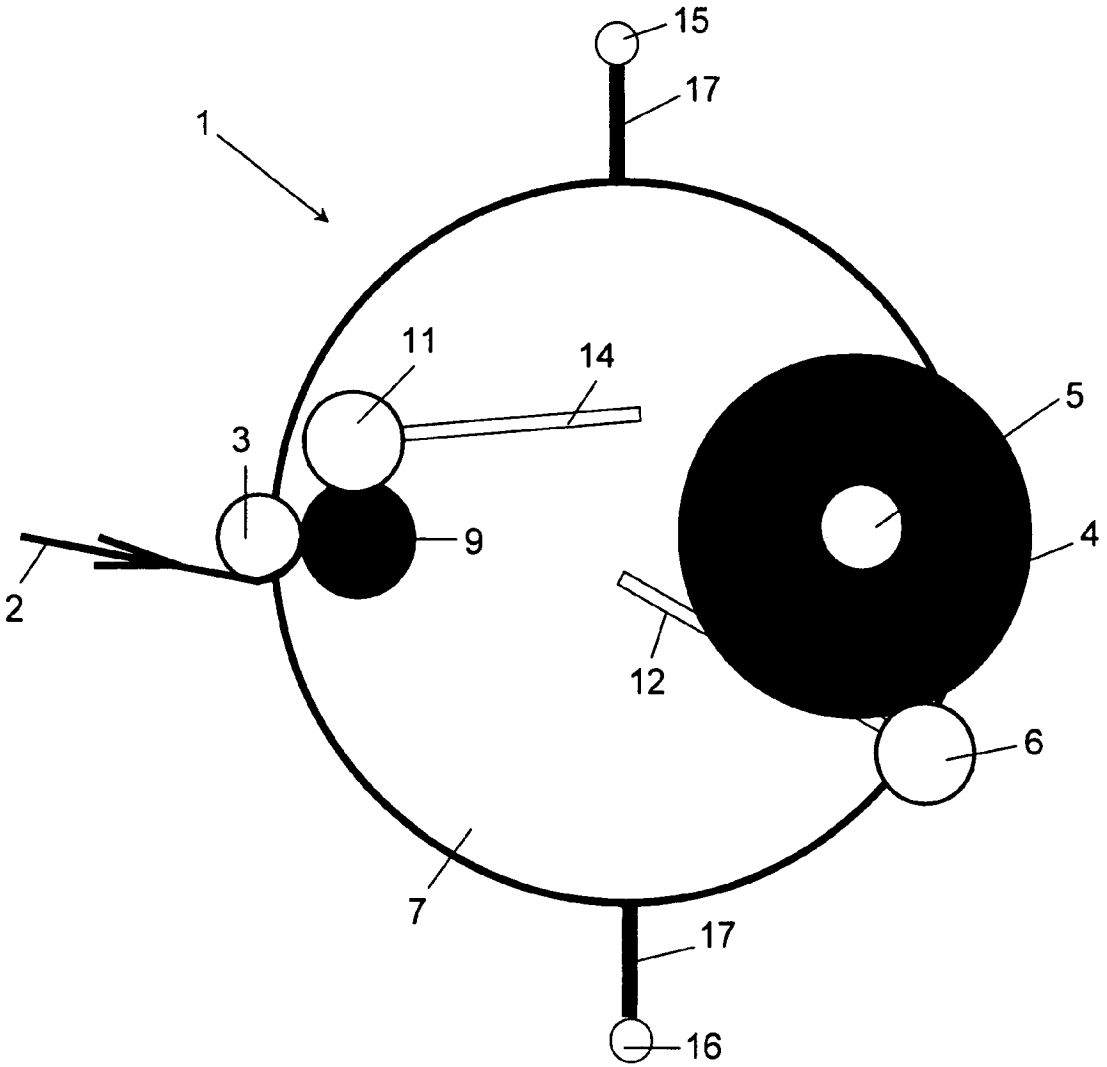
FIG. 8 shows a schematic side view of a winding device according to the invention having deflection pulleys after the roll core change.

FIG. 8 shows the operating situation, according to which the web-like material 2 has been cut through using a cutting device. The resulting web end has been wound onto the roll 4. The newly resulting web beginning has again been fixed on the new roll core 9, so that a new roll arises at this point. The lever arm 14 has been pivoted in the direction toward the roll core 9 and in this way the pressing roller has been pressed against the roll core 9 and/or the new roll.

Figure 9:
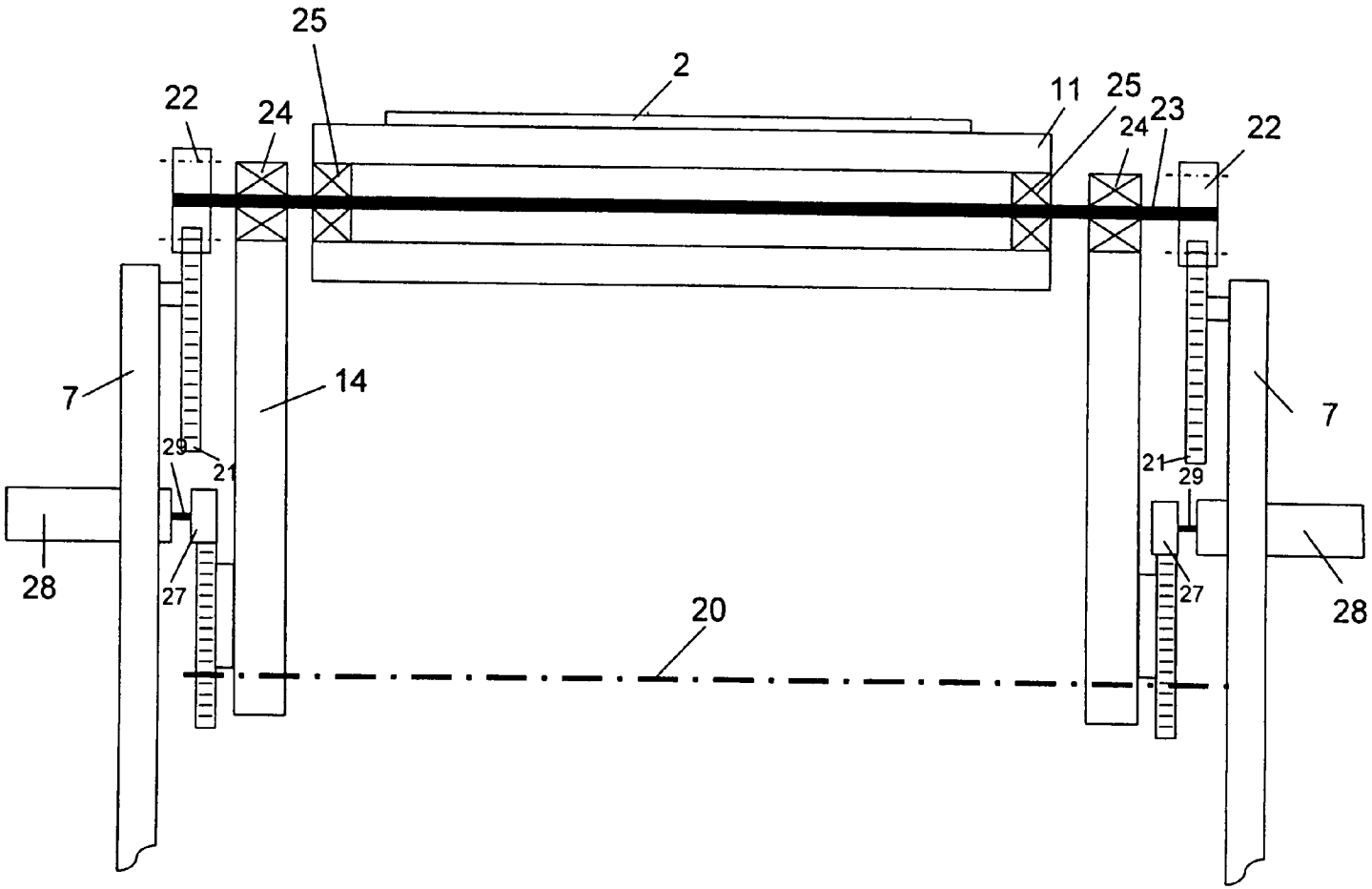
FIG. 9 shows section IX-IX indicated in FIG. 3.

FIG. 9 shows section IX-IX indicated in FIG. 3. Both discs 7 may be seen in this view, in which both lever arms 14 are rotatable around the rotational axis 20, symbolized as a dot-dash line. A gear ring or a gear ring segment 21 is fastened on each disc 7. One gear wheel 22 engages with each of these gear rings or gear ring segments 21, both gear wheels being connected rotationally fixed to a coupling shaft 23. The coupling shaft 23 is mounted so it is rotatable in the lever arms 14 via suitable bearings 24, such as ball bearings.

If the lever arms 14 are pivoted in relation to the discs 7, because of the described construction, both lever arms always assume the same pivot angle.

The pressing roller 11 is itself mounted so it is rotatable on the coupling shaft 23 using swivel bearings 25. As already described, the pressing roller is not driven. It is thus mounted so it is freely rotatable.

To be able to move the lever arms 14 in relation to the discs 7, gear wheels or gear wheel segments 26 are attached to the lever arms 14. Pinions 27, which are attached rotationally fixed to the drive shafts 29 of drive motors 28, engage with these gear wheels or gear wheel segments 26. These drive motors, which are advantageously implemented as air motors, are fastened to the discs 7.

The invention being thus described, it will be apparent that the same may be varied in many ways. Such variation are not to be regarded as a departure from the spirit and scope of the invention, and all such modifications as would be recognized by one skilled in the art are intended to be included within the scope of the following claims.

| List of reference numerals | |
|---|---|
| 1 | winding device |
| 2 | web-like material |
| 3 | contact roller |
| 4 | roll |
| 5 | roll core |
| 6 | pressing roller |
| 7 | rear disc |
| 8 | guide |
| 9 | roll core |
| 10 | further guide |
| 11 | pressing roller |
| 12 | lever arm |
| 13 | Bearing |
| 14 | lever arm |
| 15 | deflection pulley |
| 16 | deflection pulley |
| 17 | holder |
| 18 | |
| 19 | |
| 20 | rotational axis |
| 21 | gear ring or gear ring segment |
| 22 | gear wheel |
| 23 | coupling shaft |
| 24 | bearing |
| 25 | swivel bearing |
| 26 | gear wheel or gear wheel segment |
| 27 | pinion |
| 28 | drive motor |
| 29 | Driveshaft |
| A | running direction of the web-like material of the winding device |
| B | rotational direction of the disc 7 |

What is claimed is:

1. A winding device for winding up a web-like material, comprising:

a first and a second roll core each configured to receive the web-like material as the web-like material is wound up into a material roll;

a web guiding roller, which guides the web-like material before or when the web-like material reaches at least one of the first and second roll cores or the material rolls; and a pressing element, which presses the web-like material onto at least one of the first and second roll cores or the material rolls after the web-like material already rests on at least one of the first and second roll cores or the material rolls, the pressing element being movable in relation to both the first and the second roll core, the pressing element (i) being mounted at each end thereof in a lever arm forming a lever arm pair mounted so as to be rotatable and (ii) being pivotable around bearing points of the lever arms, with a pivot range of the lever arm pair extending at least between the first and second roll cores so that the pressing element can alternately contact both the first roll core and the second roll core or the material rolls.

2. The winding device according to claim 1, further comprising at least a second pressing element, which is mounted so as to be rotatable in the lever arm pair.

3. The winding device according to claim 1, wherein one of the two lever arms mounting the pressing element, and one end of the first and second roll cores, are each mounted in one disc or plate.

4. The winding device according to claim 3, wherein the discs or plates are mounted so as to be rotatable in a machine framework.

5. The winding device according to claim 1, further comprising a drive assigned to each of the first and second roll core cores, the drive exerting a drive torque on the first and second roll cores, and the drive torque being transmittable to the pressing element.

6. The winding device according to claim 1, further comprising at least one web guiding roller mounted so as to be rotatable on or in the discs or plates.

7. The winding device according to claim 6, wherein the at least one web guiding roller is provided in a running direction of the web-like material between each of the first and second roll cores.

8. The winding device according to claim 7, wherein the at least one web guiding roller lies having a rotational axis in a plane which is situated orthogonally to a surface which is spanned by the first and second roll cores, the plane extending centrally between rotational axes of the first and second roll cores.

9. The winding device according to claim 1, wherein the pressing element is a roller.

10. A method for the continuous winding of a web-like material onto rolls, comprising:

winding the web-like material onto at least one of a first and a second roll core to form a corresponding material roll;

guiding the web-like material by a web guiding roller before or when the web-like material reaches at least one of the first and second roll cores or the corresponding material roll, and pressing the web-like material by a pressing roller against at least one of the first and second roll cores or the corresponding material roll, after the web-like material already rests on at least one of the first and second roll cores or the corresponding material roll, the pressing element (i) being mounted at each end thereof in a lever arm forming a lever arm pair mounted so as to be rotatable and (ii) being pivotable around bearing points of the lever arms, with a pivot range of the lever arm pair extending at least between the first and second roll cores so that the pressing element can alternately contact both the first and the second roll core or the corresponding material rolls.

11. A winding device for winding up a web-like material, comprising:

a roll core that receives the web-like material as the web-like material is wound up into a material roll;

a web guiding roller that guides the web-like material before or when the web-like material reaches the roll core or the material roll; and a pressing roller that presses the web-like material onto the roll core or the roll after the web-like material already rests on the roll core or the roll, the pressing roller being movable in relation to the roll core, the pressing roller being mounted at each end thereof in a lever arm forming a lever arm pair mounted so as to be rotatable and so that the pressing roller is pivotable around bearing points of the lever arms, with one of the two lever arms and one end of the roll core each being mounted in at least one of a first and a second disc;

a first and a second gear ring or gear ring segment associated with a corresponding one of the first and second discs;

a first and a second gear wheel that engage the respective first or second gear ring or gear ring segment, with both gear wheels being connected rotationally fixed to a coupling shaft mounted so as to be rotatable in the lever arms, with the pressing roller mounted so as to be rotatable on the coupling shaft.

* * * * *